US011369834B2

(12) United States Patent
Ducato

(10) Patent No.: US 11,369,834 B2
(45) Date of Patent: Jun. 28, 2022

(54) PORTABLE EXERCISE ASSEMBLY AND METHOD OF ASSEMBLY

(71) Applicant: Peter A. Ducato, Santa Barbara, CA (US)

(72) Inventor: Peter A. Ducato, Santa Barbara, CA (US)

( * ) Notice: Subject to any disclaimer, the term of this patent is extended or adjusted under 35 U.S.C. 154(b) by 0 days.

(21) Appl. No.: 16/714,917

(22) Filed: Dec. 16, 2019

(65) Prior Publication Data

US 2021/0178216 A1 Jun. 17, 2021

(51) Int. Cl.
*A63B 21/00* (2006.01)
*A63B 23/12* (2006.01)

(52) U.S. Cl.
CPC ..... *A63B 21/4035* (2015.10); *A63B 23/1236* (2013.01); *A63B 2210/50* (2013.01)

(58) Field of Classification Search
CPC ..... A63B 21/0004; A63B 21/00047; A63B 21/00185; A63B 21/068; A63B 21/4027; A63B 21/4033; A63B 21/4035; A63B 23/12; A63B 23/1209; A63B 23/1236; A63B 2208/0295; A63B 2210/00; A63B 2210/50; A63B 2225/09
See application file for complete search history.

(56) References Cited

U.S. PATENT DOCUMENTS 1,552,073 A * 9/1925 Mansfeldt ..... A63B 21/045 482/50
D274,829 S 7/1984 Bankier
4,552,356 A * 11/1985 Brousseau ..... A63B 21/0004 482/125
4,717,147 A * 1/1988 Rochelle ..... A63B 21/0724 294/15
4,949,956 A * 8/1990 Pobran ..... A63B 1/00 482/23
D347,980 S * 6/1994 Butch ..... A63B 23/1236 D8/1
5,417,636 A * 5/1995 Havens ..... A63B 23/0211 482/145
D388,848 S 1/1998 Sontz
D395,210 S * 6/1998 Almsig ..... A63B 23/03541 D23/266
D439,942 S * 4/2001 Ray ..... D21/662
6,402,668 B1 * 6/2002 Harker ..... A63B 21/0004 482/121
7,044,896 B2 5/2006 Hetrick
D523,493 S 6/2006 Horton
7,163,496 B1 * 1/2007 Trotter ..... A63B 21/4035 482/100

(Continued)

OTHER PUBLICATIONS monkii.co, Monkii Bars 2, https://monkii.co/collections/workout-devices/products/monkii-bars-2, (page captured on Dec. 3, 2019).

*Primary Examiner* — Gary D Urbiel Goldner
(74) *Attorney, Agent, or Firm* — Norvell IP LLC

(57) ABSTRACT

An exercise apparatus that a user can readily assemble and disassemble includes an elongated body and two inserts. The inserts can be stored within the elongated body or can be deployed in openings in the side of the body, and in that position, the inserts operate as legs for the body. The exercise apparatus can serve as a handle for pushups. The exercise apparatus can operate independently or with a slide pad to allow the user to use sliding push-ups. When the inserts are removed, the body can serve as a handle for straps for use with suspension exercises.

20 Claims, 12 Drawing Sheets

(56) References Cited

U.S. PATENT DOCUMENTS

| | | | | |
|---|---|---|---|---|
| 7,334,499 | B2 | 2/2008 | Lai | |
| 7,806,814 | B2 | 10/2010 | Hetrick | |
| 8,043,197 | B2 | 10/2011 | Hetrick | |
| D654,544 | S | 2/2012 | Sliemers | |
| 8,784,287 | B2 | 7/2014 | Miller | |
| 9,005,146 | B2 | 4/2015 | Phillips | |
| 9,056,222 | B2 | 6/2015 | Thomason | |
| 9,308,416 | B1 * | 4/2016 | Oliverlo | A63B 23/1236 |
| 9,623,273 | B1 | 4/2017 | Chen | |
| 9,623,283 | B2 | 4/2017 | Vallo | |
| 10,213,640 | B2 * | 2/2019 | St. Jeor | A63B 21/4035 |
| 10,426,995 | B1 * | 10/2019 | Fiocchi | A63B 21/4047 |
| 11,040,241 | B1 * | 6/2021 | Fiocchi | A63B 21/4035 |
| 11,065,498 | B2 * | 7/2021 | Dalcourt | A63B 21/0004 |
| 2011/0230313 | A1 * | 9/2011 | Gamboa | A63B 23/03541 482/51 |
| 2012/0040811 | A1 * | 2/2012 | DeTore | A63B 21/00047 482/141 |
| 2014/0087925 | A1 * | 3/2014 | Dupuis | A63B 23/1236 482/97 |
| 2015/0306445 | A1 * | 10/2015 | Storum | A63B 21/4034 16/110.1 |
| 2015/0335935 | A1 * | 11/2015 | Peralo | A63B 22/20 482/93 |
| 2015/0375027 | A1 * | 12/2015 | Neal | A63B 23/1236 482/91 |
| 2018/0161618 | A1 * | 6/2018 | Viglione | A63B 21/0724 |
| 2018/0207465 | A1 * | 7/2018 | Kaye | A63B 60/24 |
| 2019/0335683 | A1 * | 11/2019 | Kuckuck | A63B 57/50 |
| 2020/0262463 | A1 * | 8/2020 | Villarreal | A63B 21/012 |
| 2020/0346065 | A1 * | 11/2020 | Dalcourt | A63B 21/4043 |

* cited by examiner

PORTABLE EXERCISE ASSEMBLY AND METHOD OF ASSEMBLY

FIELD

The present disclosure pertains generally to the field of exercise, and the illustrated embodiments relate to an exercise assembly capable of several configurations that can be easily assembled, disassembled and transported.

BACKGROUND

Society continues to place increased value on health and fitness, and experts emphasize that exercise is an important aspect of health and fitness. A form of exercise growing in popularity is training that utilizes the exerciser's own bodyweight as the source of resistance. Some common forms of this type of resistance training include not only push-ups, chin-ups, and pull ups, but also exercises using ropes, straps, bars, balls, boxes and platforms. Often this equipment is located at a specialty fitness studio or a specified area within a gym. Some individuals have dedicated space within their homes for this equipment. However, many people may not have the time or ability to travel to a studio or gym. In addition, people may not have space in their homes to store or use this equipment. Travelers may also want to be able to perform these exercises within the comfort of their hotel rooms or accommodations. A solution has been sought to assist these people.

SUMMARY

This summary is provided to introduce a selection of concepts that are further described herein below in the detailed description. This summary is not intended to identify key or essential features of the claimed subject matter, nor is it intended to be used as an aid in limiting the scope of the claimed subject matter.

In some examples, an exercise handle is provided. The exercise handle includes an elongated body having a first and a second end and one or more sidewalls between the first end and the second end. The exercise handle has an opening in the first end and a second opening in the second end. The handle has a third opening and a fourth opening in the one or more sidewalls.

In other examples, an exercise apparatus is provided. The exercise apparatus includes an elongated body having a first and a second end and one or more sidewalls between the first end and second ends. The exercise apparatus has a first opening in the first end and a second opening in the second end. The apparatus also has a third and fourth openings located on the one or more sidewalls. The exercise apparatus also has at least one insert that can be inserted into the first or second openings and also inserted into the third or fourth openings.

In other examples, a method of assembling an exercise apparatus is provided for an apparatus having an elongated body having a first and a second end, and one or more sidewalls between the first and second ends, a first opening in the first end, a second opening in the second end, a third and a fourth opening located on the one or more sidewalls, and a first insert located in said first opening and a second insert located within said second opening. The method involves removing the first insert from the first opening and inserting the first insert into the third opening and removing the second insert from the second opening and inserting the second insert into the fourth opening.

BRIEF DESCRIPTION OF THE DRAWINGS

Examples of exercise assemblies are described with reference to the following Figures. The same numbers are used throughout the Figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different assemblies described herein may be used alone or in combination with other devices and/or assemblies. Various equivalents, alternatives and modifications are possible within the scope of the appended claims.

Figure 1A:
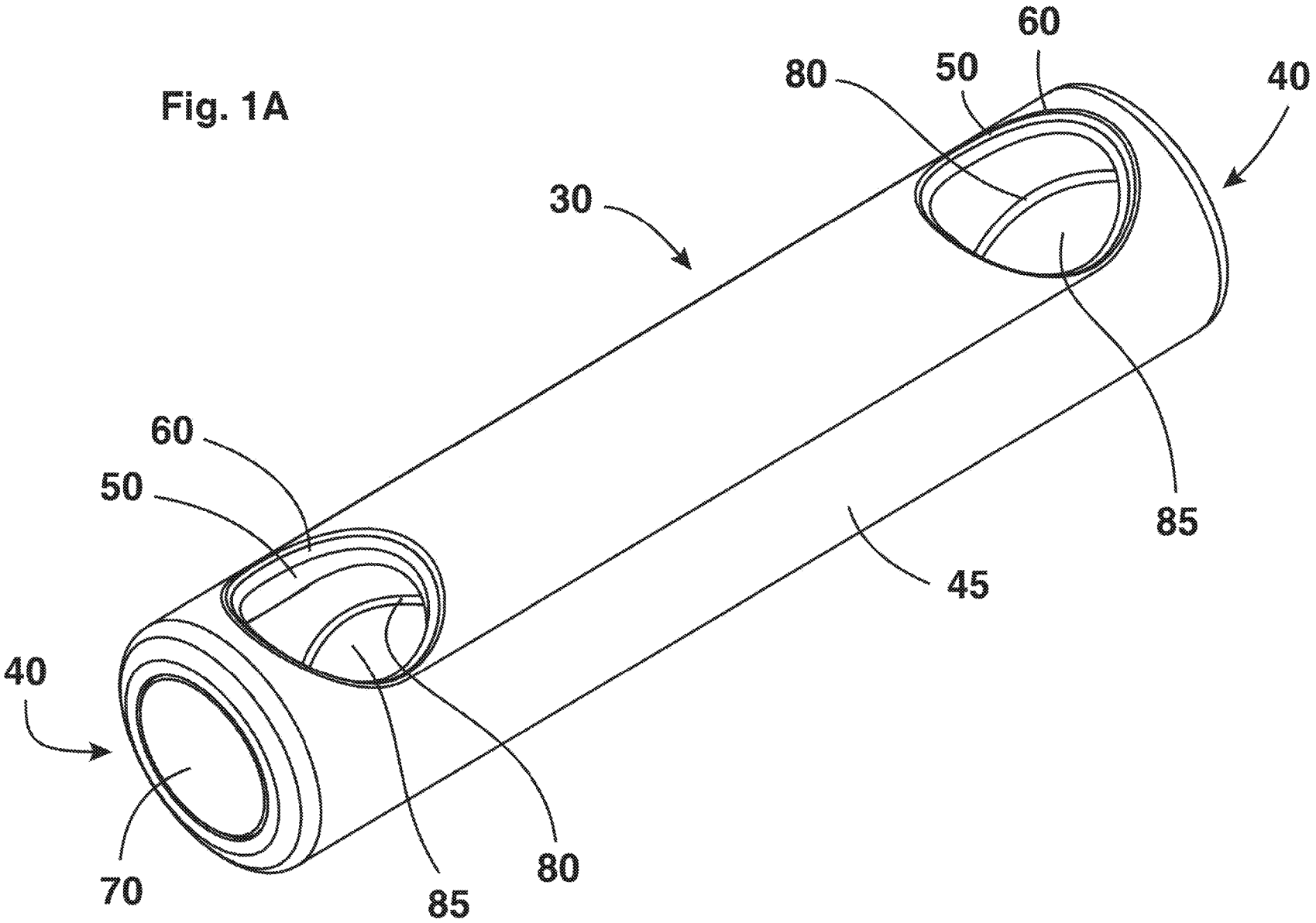
FIG. 1A is a perspective view of the body of the exercise apparatus.

FIG. 1A depicts one embodiment of the body 30 of the exercise apparatus. The body 30 serves as a handle and may have an elongated shape. The body 30 in this embodiment has a generally oval cross section, and two flat ends 40, with the ends 40 connected by a sidewall 45. However, the cross section can be circular, polygonal, asymmetrical or other shape. The corners of the cross section can be sharp or rounded.

The body 30 can be made up of one or more layers. In the displayed embodiment, the body 30 has an inner layer 50 and an outer layer 60. The inner layer 50 of the displayed embodiment can be polycarbonate and the outer layer 60 can be thermoplastic polyurethane. The layers can also be made of aluminum, stainless steel, HDPE, polyester, PVC, or other applicable materials.

In this embodiment, the body has openings 70 in both ends 40 of the body 30. The openings 70 in the present embodiment are generally round. However, they can be oval, polygonal or asymmetrical shapes. The outer edge of the opening 70 may be beveled. In addition, this embodiment includes two openings 80 in the sidewall 45 of the body 30. For a body 30 with circular cross section, the openings 80 should be centered on a single line perpendicular to the circumferences of both ends 40. In embodiments where cross section of the body 30 is a polygon, the openings 80 in the sidewall 45 of the body 30 are on the same face of the polygon. The two openings 80 on the sidewall 45 of the body 30 have approximately the same size and shape of the openings 70 on the ends. The two openings 80 also may be beveled to facilitate inserts. In the present embodiment, the body 30 is hollow within the inner layer 50 such that the openings 70 in the ends and the openings 80 in the sidewall 45 are in communication with each other.

Figure 1B:
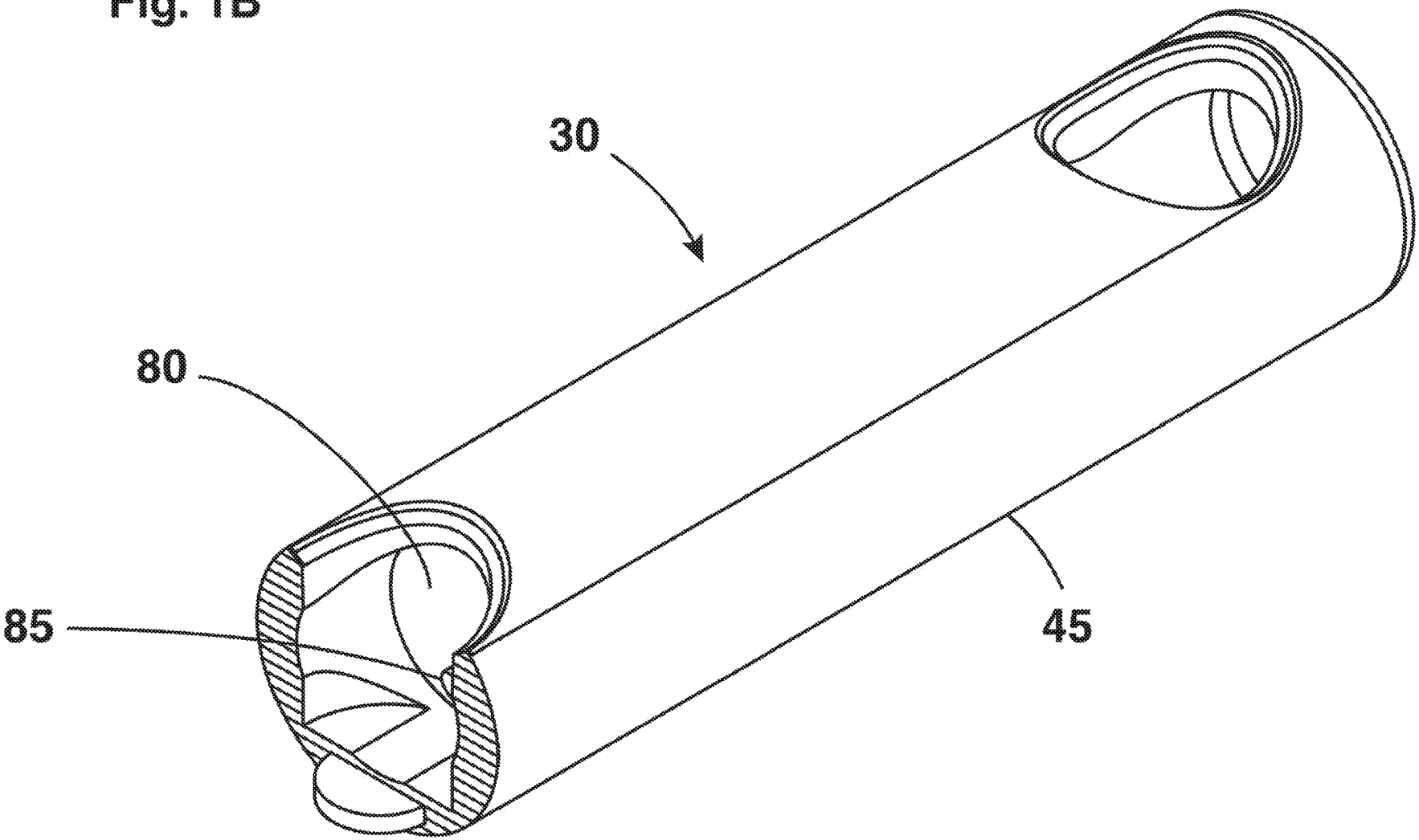
FIG. 1B is a perspective view of a cutaway of the body of the exercise apparatus.

FIG. 1B displays a cutaway view of the body of the exercise apparatus. Ferromagnetic metal inserts 85 may be located on the inner diameter of the sidewall 45 across from the openings 80.

Figure 2A:
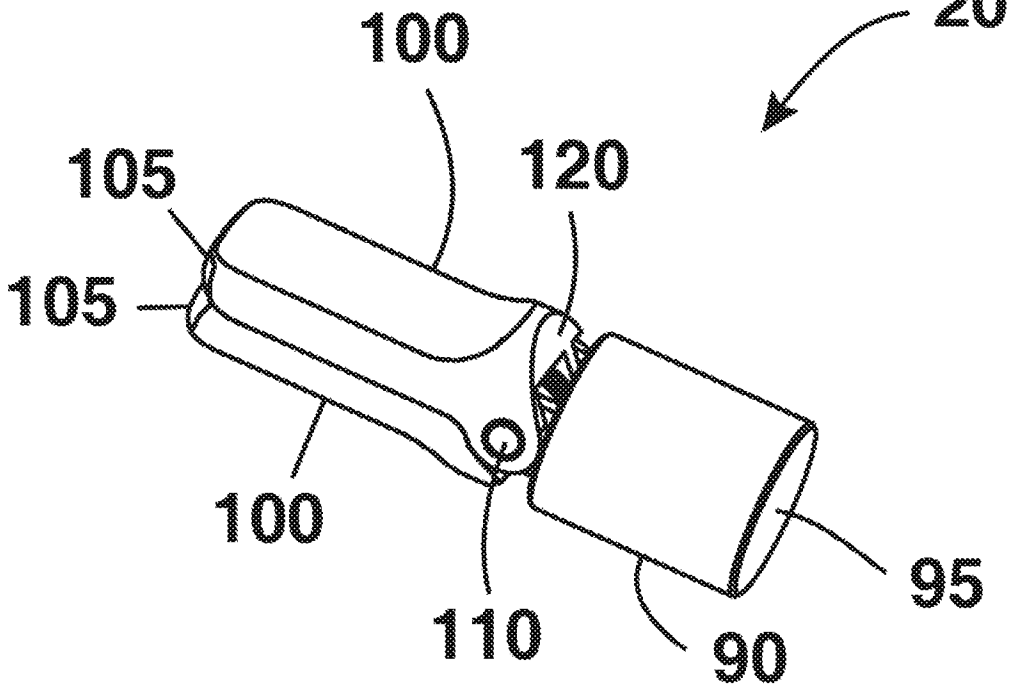
FIG. 2A is a perspective view of an insert.

FIG. 2A depicts one possible embodiment of the inserts 20 of the fitness assembly. The inserts 20 of the present embodiment have a base 90 and two legs 100. However, the insert 20 could have any of one or more legs. Each leg 100 has a grip 105 at the foot of the leg 100. In the present embodiment, the grip 105 in FIG. 2A is comprised of overmolded thermoplastic polyurethane but can be made of any material with an increased frictional coefficient and can be an insert or affixed by other known methods. The grip 105 minimizes sliding of the legs 100 over any surface upon which the legs 100 are resting.

In FIG. 2A, the legs 100 are in a closed position such that the legs 100 and the base 90 can fit within the openings 70 (FIG. 1) in the ends 40 (FIG. 1) of the body 30 (FIG. 1). The bases 90 of the inserts 20 are generally the same size and shape of the openings 70 (FIG. 1) such that the base 90 fits snuggly within the openings 70 (FIG. 1) when inserted. The base end 95 of the present embodiment is generally flat but can also have a rounded or angled shape. In the present embodiment, the base 90 is manufactured of aluminum. Alternatively, the base 90 can be made of plastic stainless steel, HDPE, or other durable materials. The legs 100 of this embodiment are manufactured of polycarbonate. Alternatively, the legs 100 can also be manufactured of plastic, aluminum, stainless steel, HDPE, polyester, PVC, or other durable materials. The tops of the legs have faces 120 designed to limit the movement of the legs when the inserts are removed from the body 30 (FIG. 1). In the present embodiment, the faces 120 have limited the opening of the legs 100 such that the angle between the legs 100 in the open position is approximately 45°. However, the faces 120 can be modified such that angle between the legs 100 in the open position is any angle that supplies sufficient stability when the exercise assembly 10 is in use. In the embodiment shown in FIG. 2A, the legs 100 are moveably attached to the base 90 by a pin 110. The pin 110 of this embodiment is manufactured of alloy steel but can also be made of any durable material.

Figure 2B:
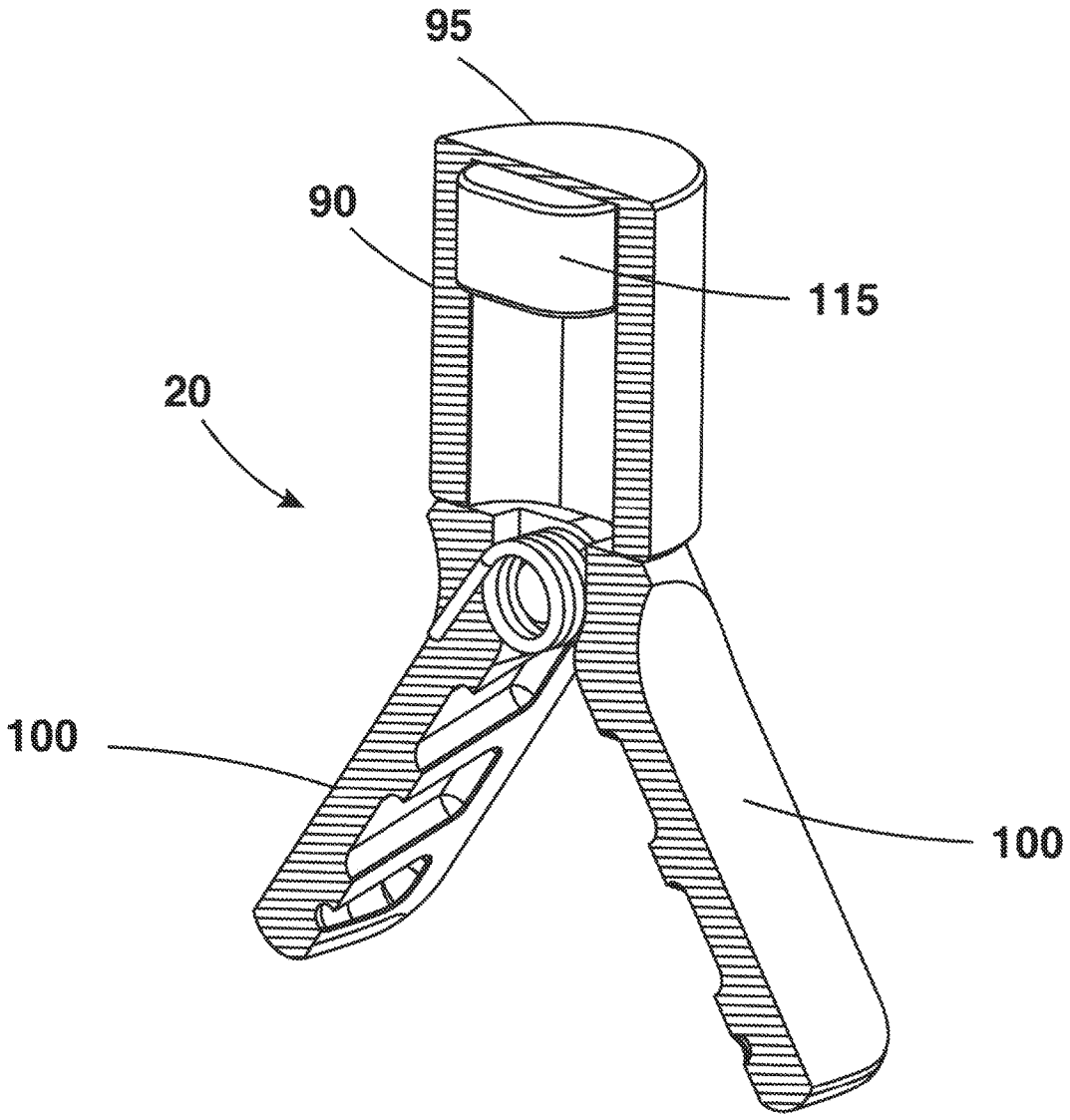
FIG. 2B is a cutaway view of the insert.

FIG. 2B displays a cutaway view of the insert 20. In the present embodiment, the interior of the base 90 is hollow. A magnet 115 is affixed within the interior of the base 90 of the insert. In the present embodiment, the magnet is affixed by glue. However, the magnet can also be molded into the body or affixed by other mechanical methods. After affixing the magnet 115, the legs 100 are attached to the base 90.

Figure 3:
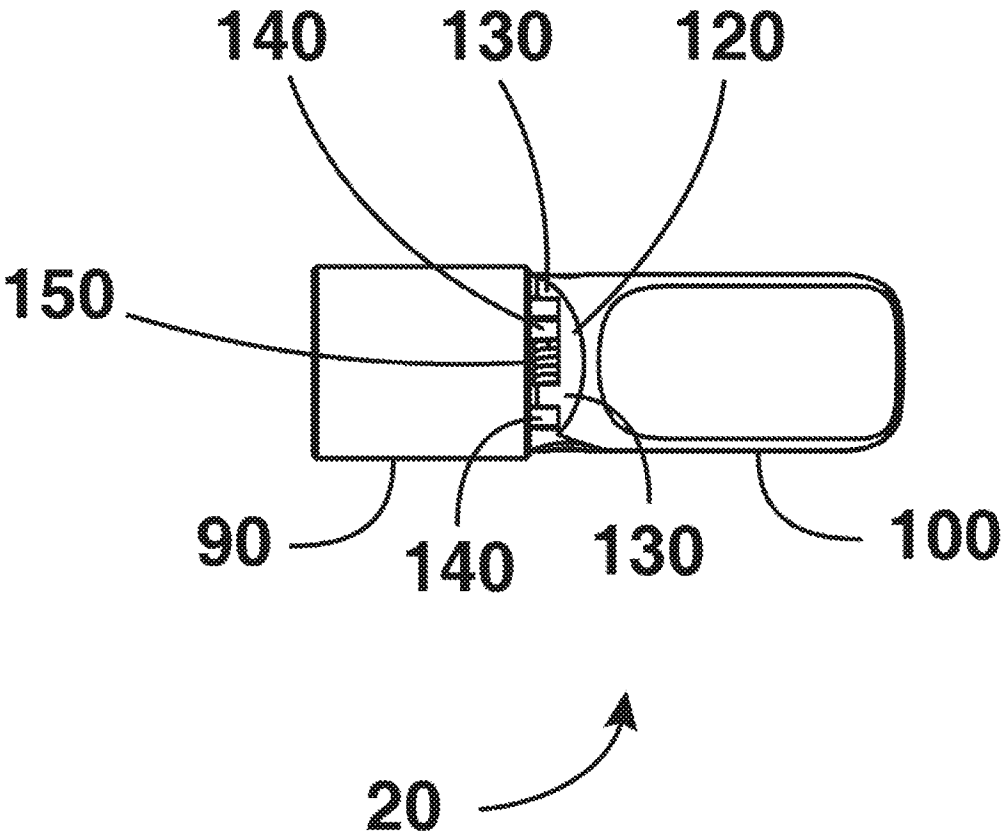
FIG. 3 is a side view of the insert.

FIG. 3 displays another view of one embodiment of the insert 20. In FIG. 3, the pin 110 (FIG. 2) runs through a leg knuckle 130, a base knuckle 140, a spring 150, another base knuckle 140, and another leg knuckle 130, functioning similar to a spring hinge and biasing the legs into an open, deployed position. The legs 100 can be attached to the base 90 by any other method that allow the mobility of the legs. For example, in an embodiment where the base 90 and legs 100 are composed of plastic, the leg knuckles and base knuckles can be molded to snap together in a manner that allows the legs 100 to rotate with relation to the base 90.

Figure 4:
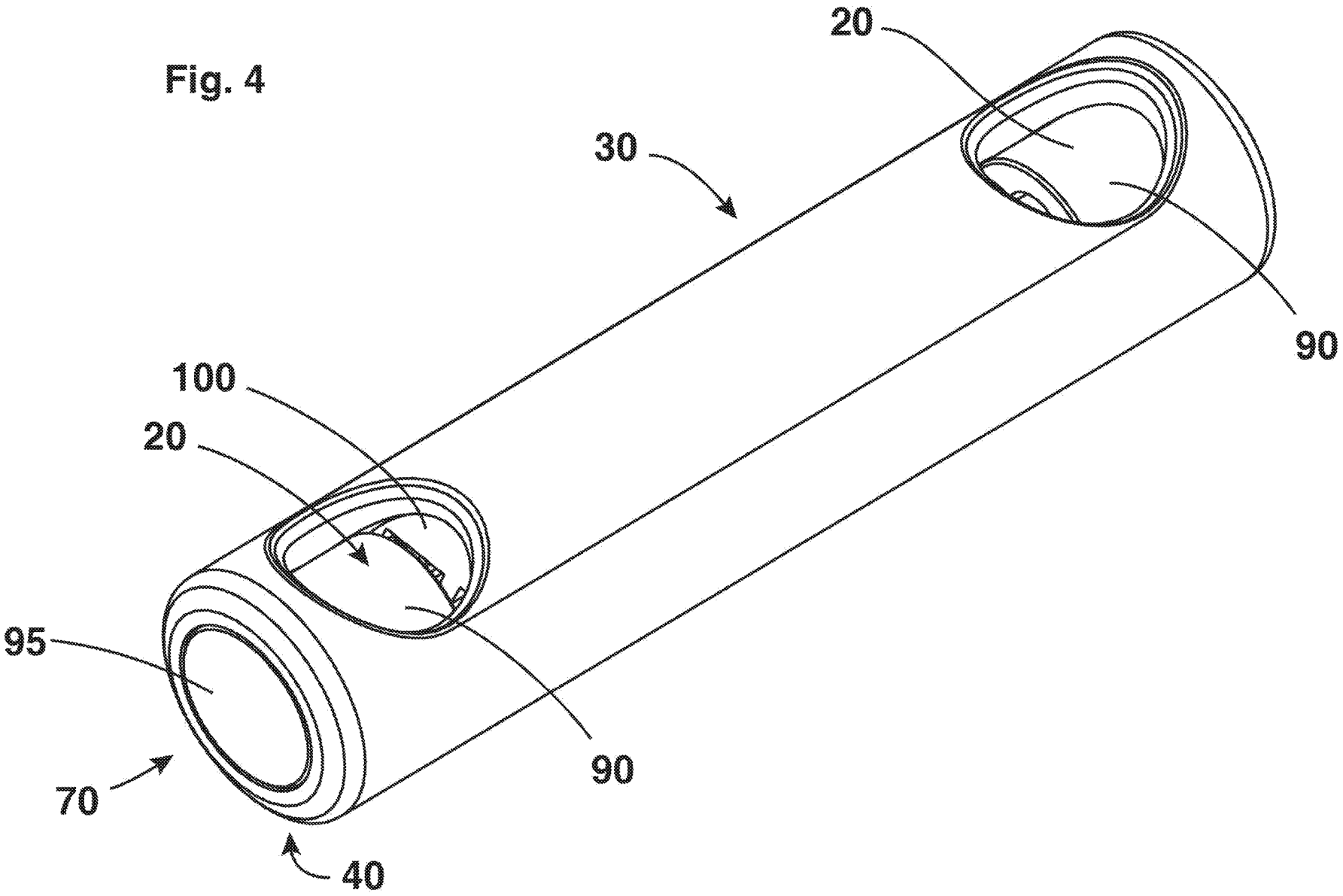
FIG. 4 is a perspective view of the exercise apparatus in a stored configuration.

FIG. 4 displays the exercise apparatus in a stored configuration where the inserts 20 are stored within the body 30. In this configuration, the springs 150 (FIG. 3) of the inserts 20 are compressed, and the legs 100 are pivoted into a closed position. In this position, the legs 100 and base 90 are inserted within the opening 70 with the legs 100 farther within the body 30, and the base 90 closer to the opening 70. In the stored configuration, magnets 115 (FIG. 2B) within the base 90 interact with the ferromagnetic metal inserts 85 to hold the insert 20 in the stored position. In the stored configuration, the base end 95 is substantially flush with the end of the body 40. In the stored configuration, the exercise apparatus consumes substantially less space, allowing a user to pack the exercise apparatus for travel or storage when not in use.

Figure 5:
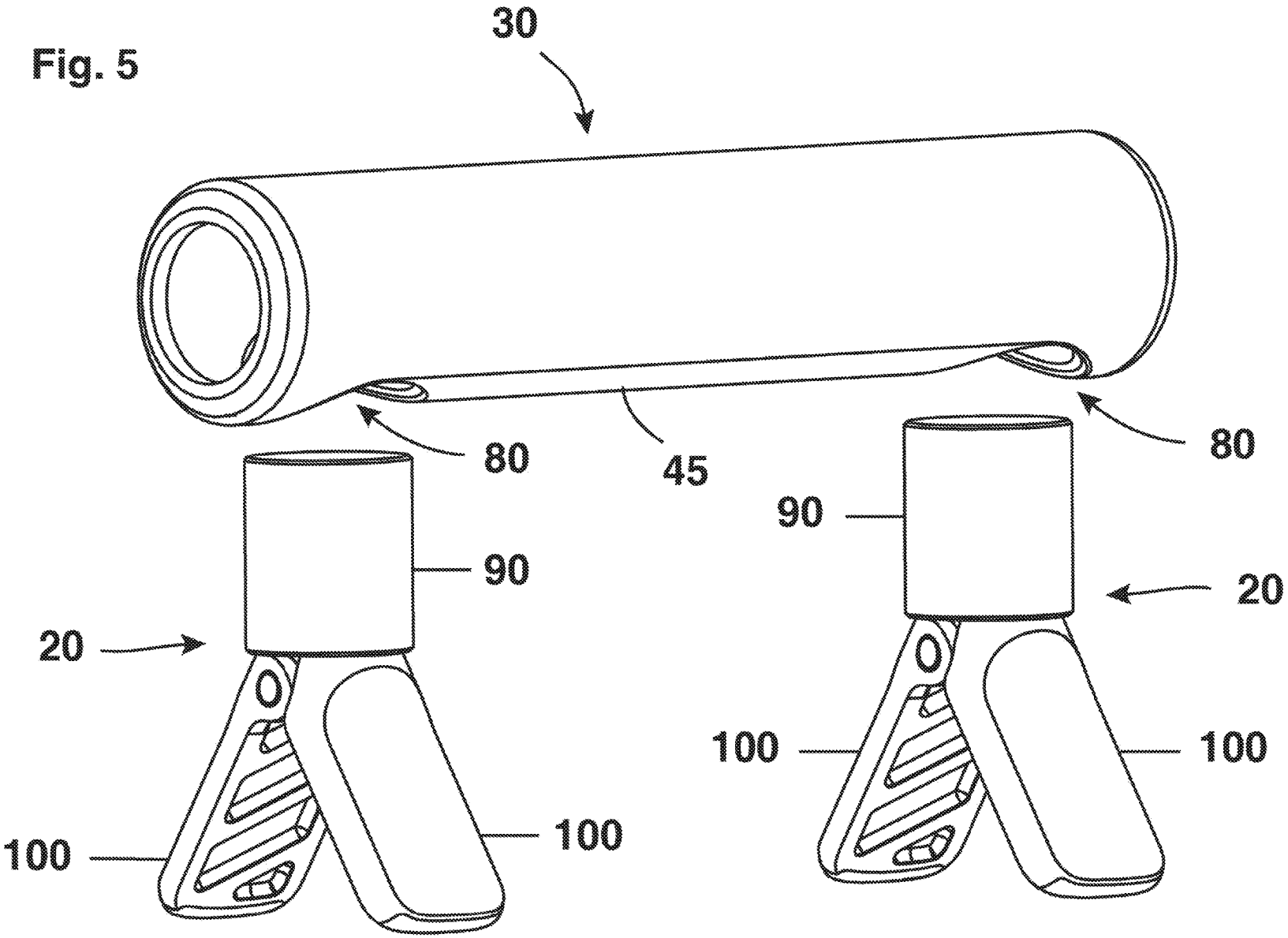
FIG. 5 is a side view of the exercise apparatus with the inserts removed from the body and rotated.

FIG. 5 displays the fitness assembly with the inserts 20 removed from the body 30. When the inserts 20 are removed from the body 30, the springs 150 (FIG. 3) decompress, spreading the legs 100 until the movement is limited by the face 120 (FIG. 2A) making contact with the base 90. The inserts 30 are then rotated 90° in anticipation of being inserted into the openings 80 in the side 45 of the body 30.

Figure 6:
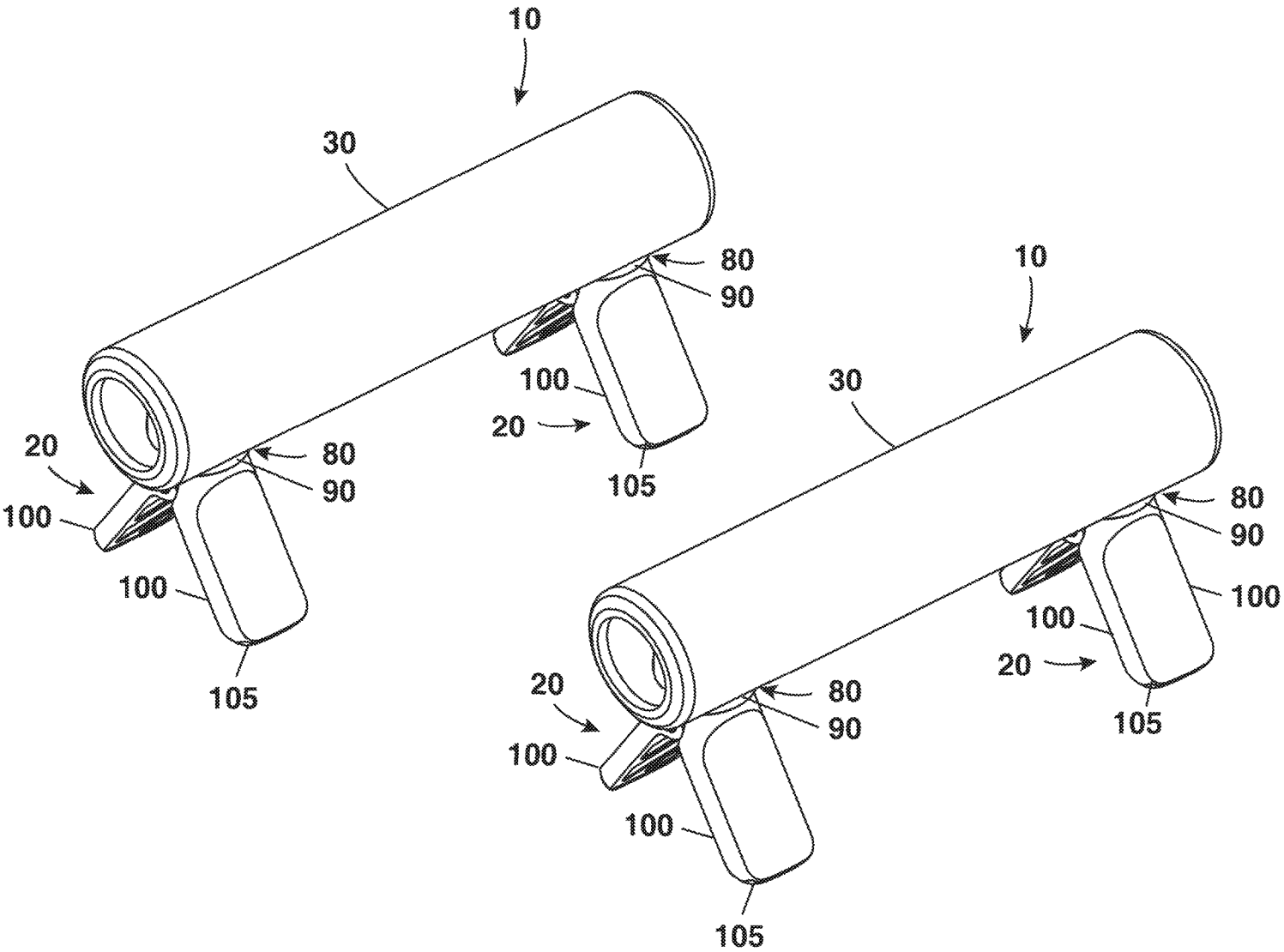
FIG. 6 is a perspective view of two exercise apparatus in push-up configuration.

FIG. 6 displays a pair of the exercise apparatus 10 in the push-up configuration. In this embodiment, the bases 90 of the inserts 20 have been inserted into the openings 80 in the side 45 of the body 30. The shape of the bases 90 should be approximately the same size and shape of the openings 80 on the side of the body 30, such that the bases 90 fit snuggly within the openings 80 on the side of the body 30. The grips 105 on the four legs 100 may be capable of creating a plane such that the exercise apparatus 10 may be able to rest stably on a flat surface, allowing a user of the exercise apparatus 10 to grab the body with the user's hand, and place some or all of the user's body weight onto one or more of the exercise apparatus. In this configuration, a user may utilize two exercise apparatus 10 to do push-ups with the exercise apparatus in a stationary position. The exercise apparatus 10 may also be used with a slider pad, as described hereafter.

Figure 7A:
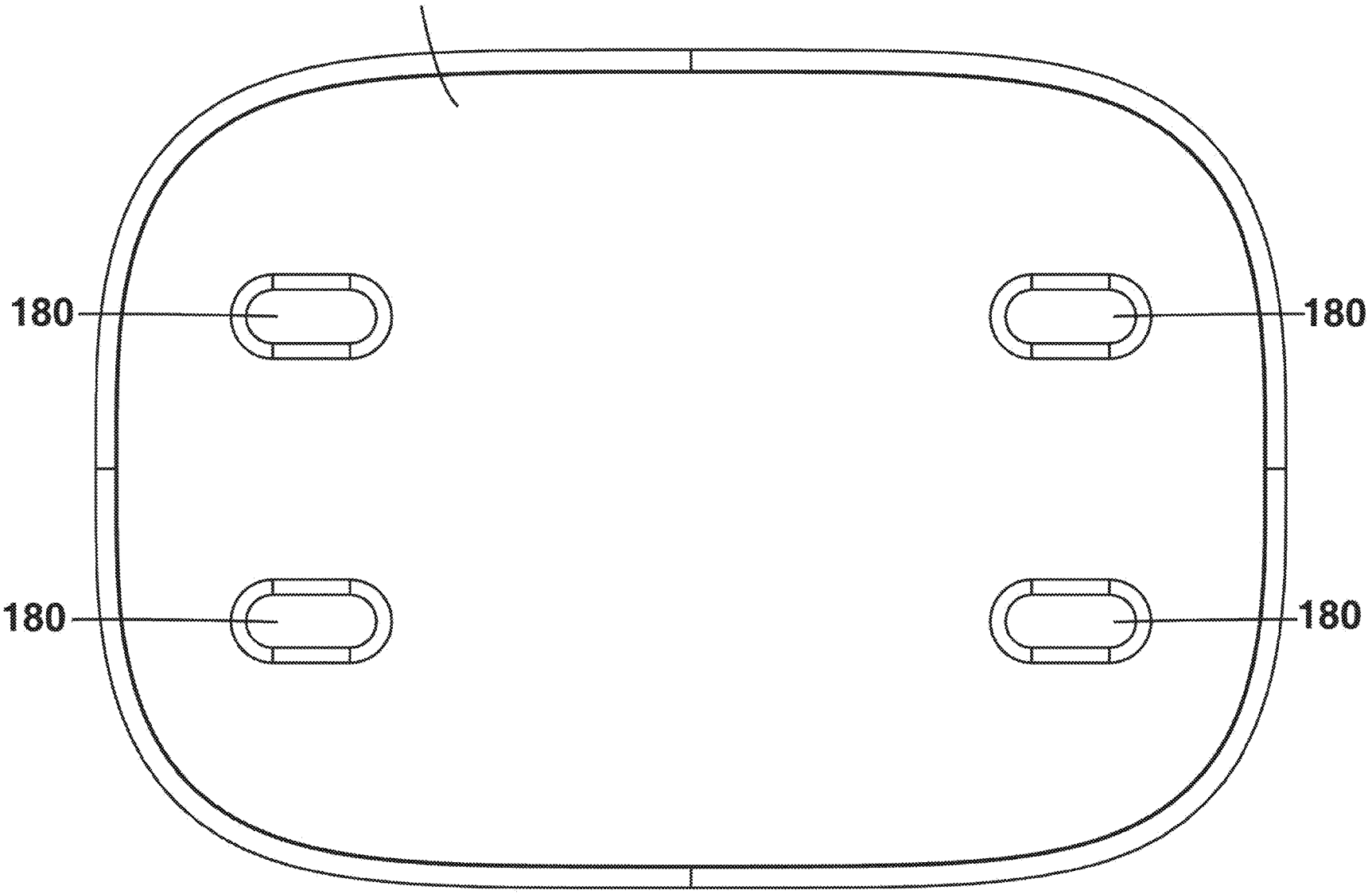
FIG. 7A is a top view of the top layer of the slider pad
Figure 7B:
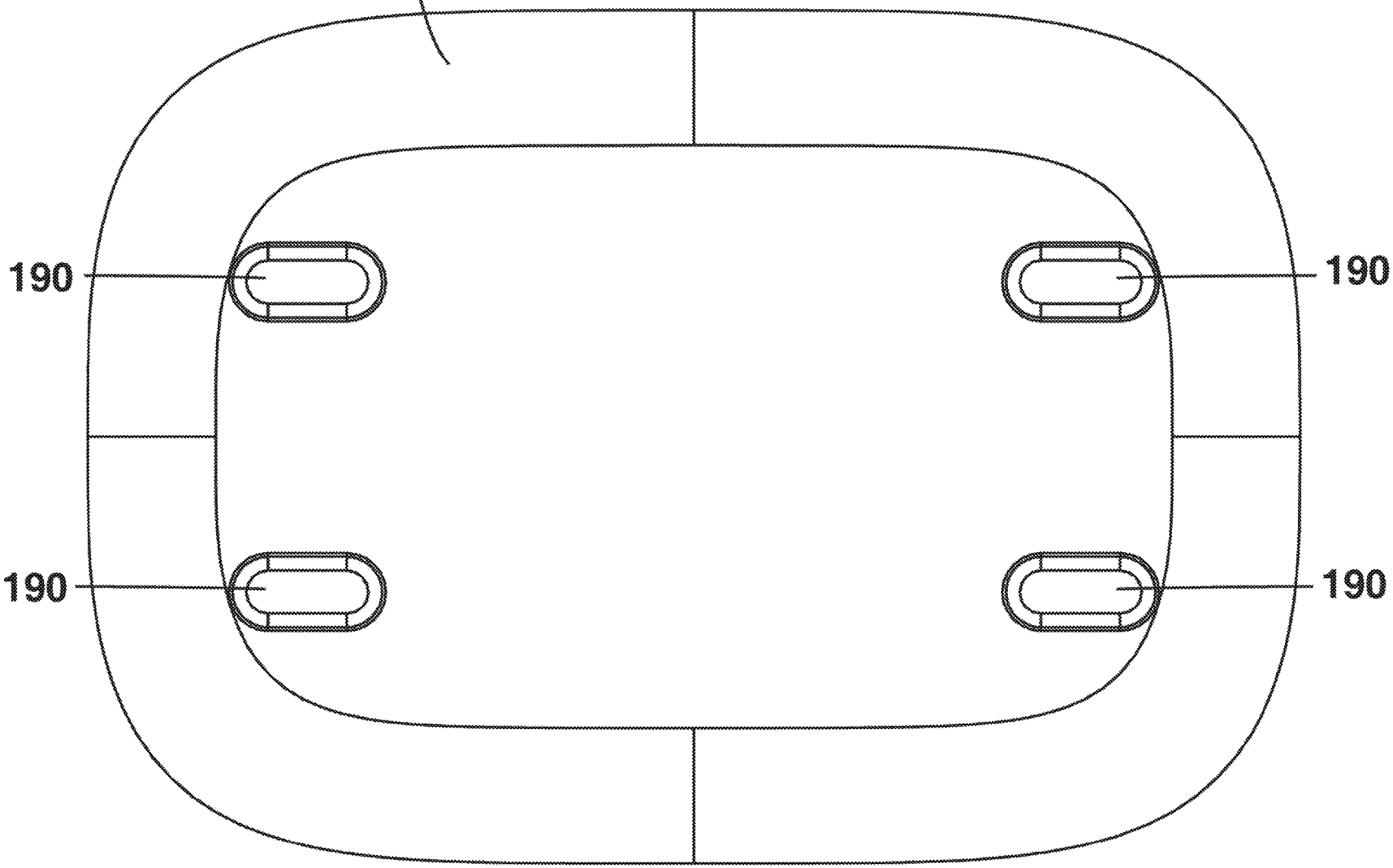
FIG. 7B is a top view of the bottom layer of the slider pad.

FIGS. 7A and 7B show a top view of a top layer and bottom layer respectively of a slider pad that can be used with the exercise apparatus 10. Figure A shows the first layer of the slider pad. The first layer of the slider pad is comprised of a foam layer 160. In the present embodiment, the first layer has four voids 180 that correspond to the four legs 100 (FIG. 6) of the exercise apparatus 10 (FIG. 6) in its push-up configuration. FIG. 7B displays the second, plastic layer 170. The second, plastic layer 170 comprises a hard plastic plate with a glossy texture. The second, plastic layer 170 also has four recesses 190 that correspond to the four legs 100 (FIG. 6). The use of this material as a bottom layer reduces the friction between the surface upon which it sits, allowing the slider pad to slide freely along the surface. The slider pad can function with either the first layer 160 or the second layer 170 in contact with a surface. The first layer 160 is designed to easily slide on hard surfaces. For use on carpeted surfaces, the slider pad can be flipped so that the second, plastic layer 170 is in contact with surface. In each instance, the legs 100 (FIG. 6) will fit into the recesses in the first layer 180 or the recesses in the second layer 190.

Figure 8:
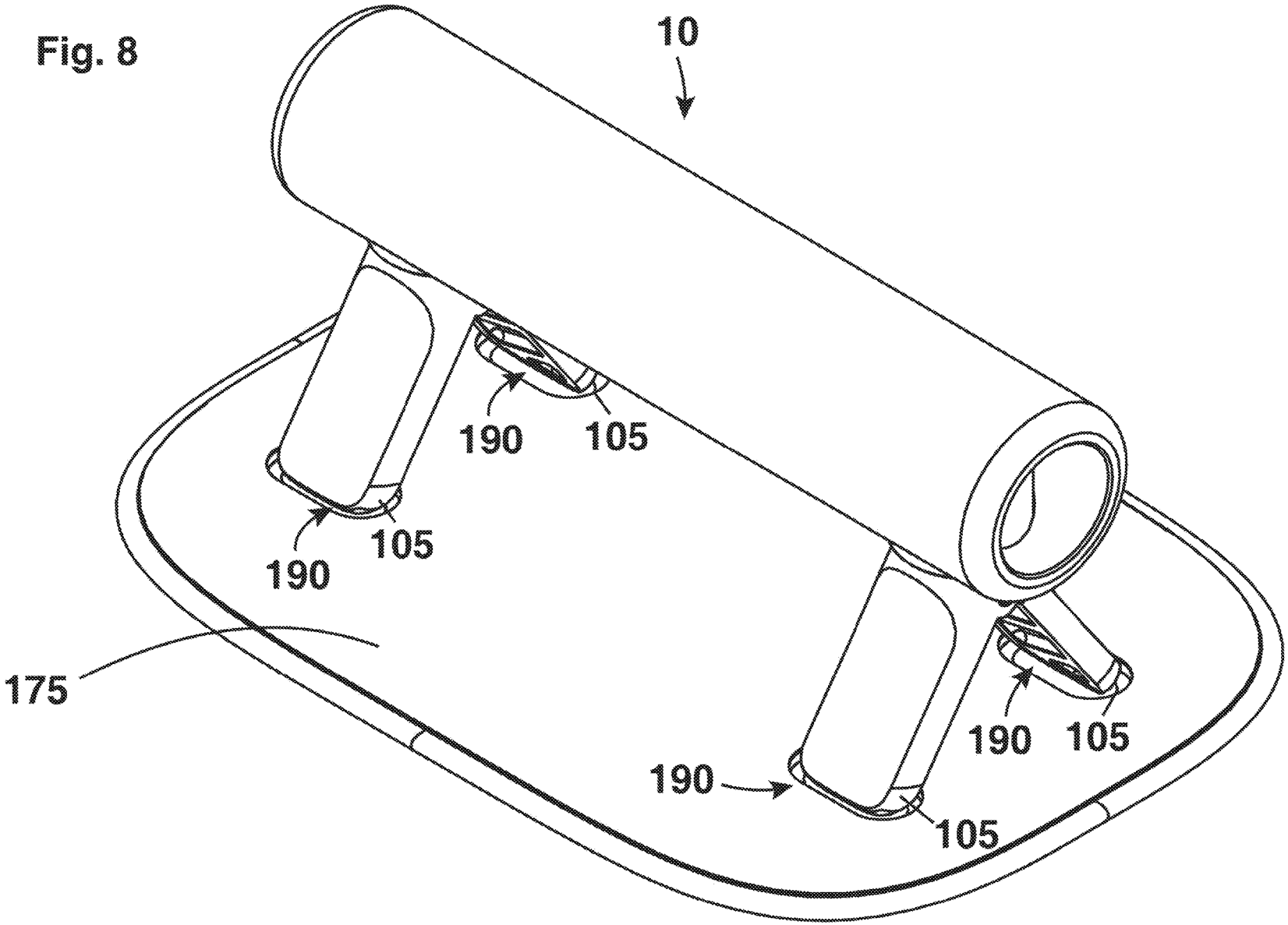
FIG. 8 is a perspective view of the exercise apparatus in a slider configuration.

FIG. 8 displays the exercise apparatus 10 operating with the slider pad 175. In this use, the exercise apparatus 10 rests on the slider pad 175 such that the grips 105 contact the four recesses 190 of the hard plastic plate 170. The contact between the grips 105 and the recesses 190 ensure that exercise apparatus 10 and the slider pad move in a unitary manner. In use, the combination of the exercise apparatus 10 and slider pads 175 allows a user to perform sliding pushups, wherein the user, having a combination of the exercise apparatus and slider pad in both the user's right and left hands, can vary the width of the user's arms either between push-ups, or during the raising or lowering of the user's body during the push-up.

Figure 9:
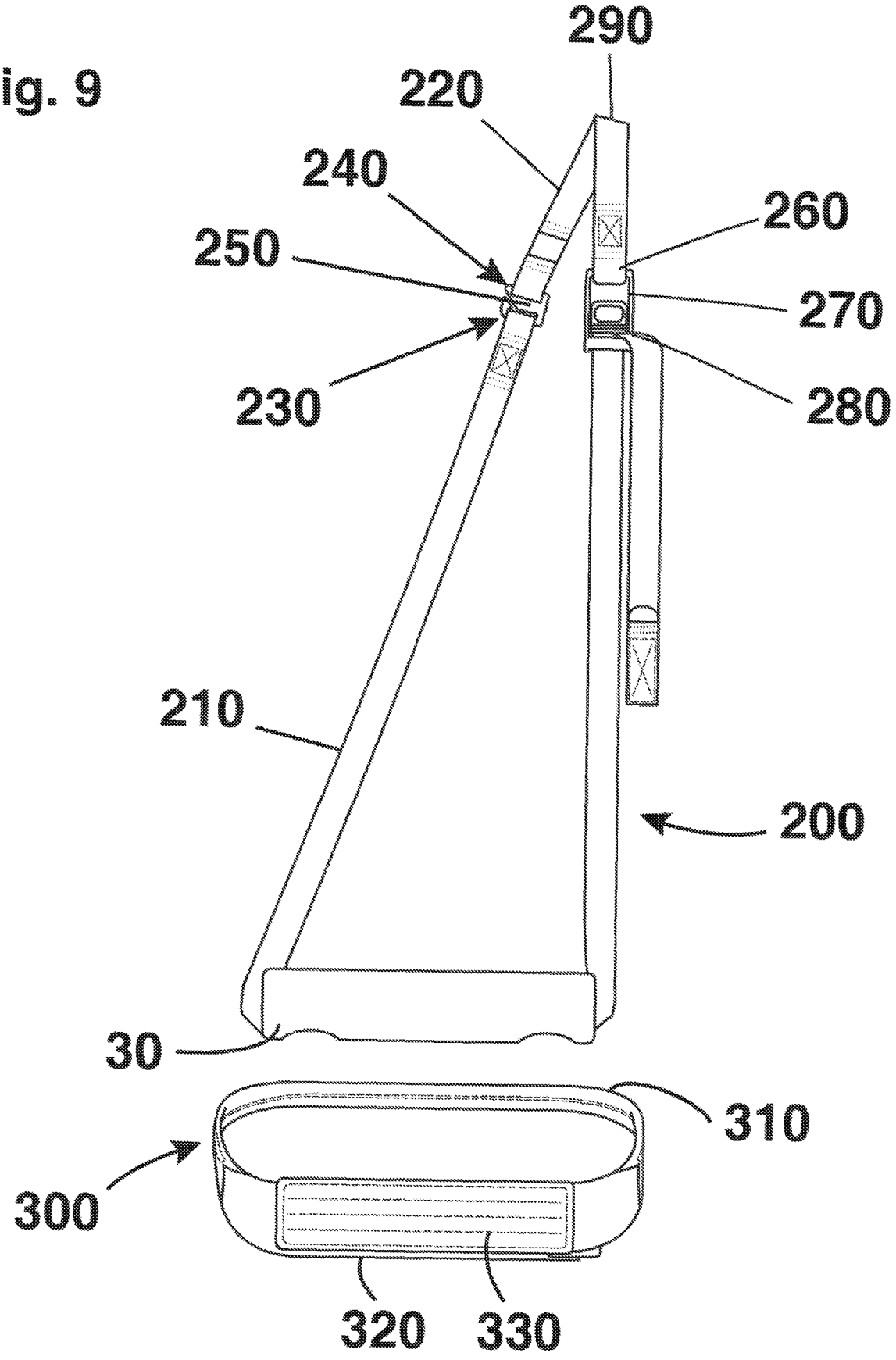
FIG. 9 is a perspective view of the exercise apparatus of the exercise apparatus in suspension configuration.

FIG. 9 displays the exercise apparatus in the suspension configuration. In this configuration, the inserts 90 are removed from the body 30. A strap 200 is run through the hollow body 30. The strap 200 is made of a first segment 210 and a second segment 220. Each segment has a stitched loop end, 230, 240. The stitched loop ends are linked to each other with a hardware 250. In this embodiment, the hardware 250 is a G hook. The other end of one strap 260 is permanently affixed to hardware, in this embodiment, a cam buckle 270, and the other end of the other strap 280 is adjustably looped through the hardware to allow the user to increase or decrease the length of the strap. The cam buckle 270 in this embodiment is made of stainless-steel, but can also be made of other materials, such as plastic. The strap can then be suspended from a hook or other fixture 290. In this configuration, the user can use the handle to perform suspension exercises, such as curls, flys, presses and extensions, as well as many others. In addition, a foot support 300 can be attached to the body 30. The foot support 300 comprises a nylon strap 310 with two ends 320, 300. The two ends 320, 330 have a hook and loop attachment mechanism, but can alternatively attach using clips, hooks or other means. The ends 320, 330 will be detached, the nylon strap 310 will be run through the body 30, and the ends 320, 330 will then be attached to each other. In this configuration, a user can place a foot or feet in one more foot supports 300 and perform additional exercises that require the user's feet to be suspended above the ground. Although only a few examples have been described in detail above, those having ordinary skill in the art will readily appreciate that many modifications are possible in examples without materially departing from the invention. All such modifications are intended to be included within the scope of this disclosure as defined in the claims.

The invention claimed is:

1. An exercise handle comprising:

an elongated body having a first end, a second end, and at least one sidewall between said first end and said second end;

a first opening in said first end;

a second opening in said second end;

a third opening in said at least one sidewall; and a fourth opening in said at least one sidewalk;

wherein the at least one of said first and second openings and the at least one of said third and fourth openings can accommodate a common insert having a first insert end and a second insert end, said second insert end comprising at least one leg that is movably attached to said first insert end by a pin.

2. The exercise handle of claim 1 wherein at least one of said first and second openings is approximately a same shape and size of at least one of said third and fourth openings.

3. The exercise handle of claim 2 wherein said first insert end is approximately said same shape and size of the at least one of said first and second openings and the at least one of said third and fourth openings.

4. The exercise handle of claim 3 wherein said second insert end comprises a first and a second leg.

5. The exercise handle of claim 4 wherein said first and second legs are movably attached to said first insert end by said pin.

6. The exercise handle of claim 5 where said first and second legs are biased into an open position by a spring.

7. The exercise handle of claim 3 further comprises ferromagnetic metal inserts within an interior of said elongated body proximate to said third and fourth openings, and a corresponding magnet to each of said ferromagnetic metal inserts is located within each of said first insert ends.

8. The exercise handle of claim 1 wherein said elongated body is hollow, such that said first opening is in physical communication with said second opening such that an object can travel through said elongated body from said first opening to said second opening.

9. The exercise handle of claim 7 further comprising a strap that travels through said elongated body from said first opening to said second opening, said strap further comprising two ends capable of connecting such that said strap forms a closed loop capable of being hung or suspended.

10. The exercise handle of claim 1 wherein said elongated body has an oval profile.

11. An exercise apparatus comprising:

an elongated body having a first end, a second end, and at least one sidewall between said first end and said second end, wherein a first opening is located in said first end, a second opening is located in said second end, a third opening is located on said at least one sidewall, and a fourth opening is located on said at least sidewall; and at least one insert, wherein said at least one insert can be inserted into at least one of said first and second openings and also inserted into at least one of said third and fourth openings, said at least one insert having a first insert end and a second insert end, said second insert end comprising at least one leg that is movably attached to said first insert end by a pin.

12. The exercise apparatus of claim 11, wherein said first insert end is approximately a same size and shape of the at least one of said first and second openings.

13. The exercise apparatus of claim 12, wherein said second insert end comprises two legs movably attached to said first insert end by a said pin.

14. The exercise apparatus of claim 13, wherein said two legs are biased open with a spring.

15. The exercise apparatus of claim 12 further comprising a slider pad in contact with said at least one leg.

16. The exercise apparatus of claim 15 wherein said slider pad further comprises a first side comprising a fabric-laminated foam and a second side comprising a smooth plastic, and wherein both said first and said second sides have at least one receptacle to receive said at least one leg.

17. The exercise apparatus of claim 11 wherein said first opening is in physical communication with said second opening, the exercise apparatus further comprising a strap that travels through said elongated body from said first opening to said second opening, said strap further comprising two ends capable of connecting such that said strap forms a closed loop capable of being hung or suspended.

18. A method of assembling an exercise apparatus, the method comprising providing said exercising apparatus comprising:

an elongated body having a first end, a second end, and at least one sidewall between said first end and said second end, wherein a first opening is located in said first end, a second opening is located in said second end, and a third opening and a fourth opening are located on said at least one sidewall; and a first insert and a second insert, wherein each of said first insert and said second insert has a first insert end and a second insert end, said second insert end comprising at least one leg that is movably attached to said first insert end by a pin;

locating said first insert within said first opening;

locating said second insert within said second opening;

removing said first insert from said first opening and inserting said first insert into said third opening; and removing said second insert from said second opening and inserting said second insert into said fourth opening.

19. The method of claim 18 wherein the step of locating said first insert within said first opening is such that said second insert end is located within said elongated body, and wherein the step of inserting said first insert into said third opening is such that said first insert end is located in said third opening.

20. The method of claim 19 wherein said second insert has a third insert end and a fourth insert end, wherein the step of locating said second insert within said second opening is such that said fourth insert end is located within said elongated body, and wherein the step of inserting said second insert into said fourth opening is such that said third insert end is located in said fourth opening.

* * * * *